US005226378A

United States Patent [19]

Suzuki et al.

[11] Patent Number: 5,226,378

[45] Date of Patent: Jul. 13, 1993

[54] AUTOMATIC SEWING APPARATUS FOR FORMING A TUBULAR SLEEVE BY HEMMING AND CLOSING A BLANK OF THE SLEEVE

[75] Inventors: Yukinori Suzuki, Toyohashi; Hayami Kawamoto, Suita; Tatsuaki Kaneda, Nishinomiya; Masahiko Nishikawa, Suita, all of Japan

[73] Assignee: Pegasus Sewing Machine Mfg. Co., Ltd., Osaka, Japan

[21] Appl. No.: 855,911

[22] Filed: Mar. 23, 1992

[30] Foreign Application Priority Data

Aug. 26, 1991 [JP] Japan ..... 3-213876

[51] Int. Cl.[5] ..... D05B 21/00; D05B 25/00; D05B 35/02

[52] U.S. Cl. ..... 112/121.12; 112/121.15; 112/141; 112/147; 112/155; 112/304; 112/306

[58] Field of Search ..... 112/121.12, 121.15, 112/141, 147, 121.29, 304, 306, 262.3, 262.2, 153, 155

[56] References Cited

U.S. PATENT DOCUMENTS 3,192,885 8/1961 Timm ..... 112/2
3,474,747 10/1969 Noiles ..... 112/121.12
4,214,541 12/1977 Zeigler et al. ..... 112/262.3
4,428,315 1/1984 Keeton ..... 112/121.12 X
4,530,295 7/1985 Adamski et al. ..... 112/141 X
4,531,721 7/1985 Kosrow ..... 112/262.3 X
4,800,830 3/1988 Adamski et al. ..... 112/303
4,825,787 5/1989 Babson et al. ..... 112/306 X
4,934,293 6/1990 Yokota et al. ..... 112/288

*Primary Examiner*—Peter Nerbun
*Attorney, Agent, or Firm*—Jones, Tullar & Cooper

[57] ABSTRACT

An automatic sewing apparatus for hemming and closing a sleeve is used for making a tubular sleeve a short-sleeved T-shirt. After placing the sleeve blanks on a conveyor only, subsequent operations are done fully automatically and continuously to make tubular sleeves, resulting in labor savings, productivity enhancement, and a reduction in savings production cost. In particular two types of shapes cut for sleeves can be sewn by using the apparatus by turning them in the appropriate direction. The apparatus comprises a first sewing machine for hemming and a second sewing machine for edge sewing disposed at both inner corner sides of an L-shaped sewing table, a blank feed device installed at a table part of the first sewing machine side, a folding member for the blank edge, a hemmed piece deflecting device, and direction turning members for turning the deflected piece.

9 Claims, 12 Drawing Sheets

AUTOMATIC SEWING APPARATUS FOR FORMING A TUBULAR SLEEVE BY HEMMING AND CLOSING A BLANK OF THE SLEEVE

BACKGROUND OF THE INVENTION

1. Field of the Invention

The present invention relates to an automatic sewing apparatus for hemming and closing a sleeve used in automatically making a tubular sleeve from a sleeve blank by sewing machines.

The apparatus for making a sleeve, such as making the short sleeve of a T-shirt, requires a device for making a folded line by folding an edge of the sleeve blank in an S-form, a sewing machine for hemming the blank along the folded line, a device for folding the hemmed piece in two along a line orthogonal to the hemming line, that is, folding in halves, and another sewing machine for sewing the edges of the folded piece together into a tubular form.

2. Description of the Prior Art

In the sleeve making apparatus including the noted devices, generally hitherto, each device was mutually separated and some steps of the process of making the sleeve with the apparatus is separated according to the devices. That is, one operator hems with a sewing machine, and the hemmed piece is taken out of the sewing machine and manually folded in half by another operator, and the folded piece is fed into another sewing machine by another operator, then the edges of the folded blank are sewn together.

In such a sleeve making process with such separated steps many operators are required and an assembly line is generally formed in order to improve productivity. Even in the assembly line, a waiting time between consecutive steps is likely to occur, and overall job efficiency is, consequently not high. Therefore, product cost is forced to increase, and working space for folding the blank is needed, aside from the space for installing two sewing machines, and a large working space is required on the whole.

Contrary to the manual work, U.S. Pat. No. 4,428,315 discloses a fully automated assembly for a sleeve making apparatus. In this assembly, by raising the pickup head engaged with the center line of the back side of the sleeve blank, the sleeve blank is folded in, two in the vertical plane, and free edges of the folded blank are put on a conveyor to convey the blank along a folding line direction, then the blank is drawn out of the pickup head and folded in halves.

The assembly disclosed in the noted patent is a fully automatic sleeve making apparatus, which saves labor and installation space, improves efficiency, and lowers product cost. In such an automatic sewing apparatus, however, the blank fold apparatus is very complicated, and it is necessary to pick up the entire blank to and fold it in two, and draw out the folded blank while sliding on the pickup head, so that if the blank is, for example, slippery, it is hard to form the fold neatly. And even when it is folded neatly, it is often somewhat when unfolded the blank is drawn out from the pickup head, so that actually a neatly folded blank is not obtained. As a result, it is very difficult to make a tubular sleeve as intended.

Furthermore, the blank for forming a sleeve is roughly divided into two types by the cutting shape. One is a linear edge type which forms an acute angle between the hemming line and the edges to be sewn together next in order to make the blank folded in two after hemming tubular, and the other is a bent edge on an intermediate part of the edges of the blank. In these two types of blanks, it is necessary to turn the edge direction at the beginning of sewing or in the midst of sewing, but such an operation was not taken into consideration in the conventional fully automatic apparatus disclosed in the above noted patent.

SUMMARY OF THE INVENTION

It is, therefore, a primary object of the invention to provide an automatic sewing apparatus for hemming and closing a sleeve capable of making a tubular sleeve as specified at high productivity by exhibiting an accurate blank deflecting function and adequate edge direction turning function, in a simple structure, while reducing cost by saving labor and enhancing efficiency by totally automating.

It is another object of the invention to fabricate two types of sleeves, by using only one apparatus, including the adequate direction turning function on two blanks differing in the cutting shape.

To achieve the above objects, the invention presents an automatic sewing apparatus for hemming and closing a blank comprising:

a sewing table having an L-shaped blank mounting surface and inner corner sides:

a first sewing machine for hemming the blank to form a hemmed piece, the first sewing machine being installed on the sewing table at one inner corner side;

a feed device having a conveying surface in the same plane as the sewing table;

a folding device for folding back the edge of an opening side of the blank along the running direction, the folding device being installed on the conveying surface of the feed device before the first sewing machine;

at least one sensor for detecting the hemmed piece on the conveying surface;

a deflecting device for folding the hemmed piece into halves along a line orthogonal to the hemming line, so that a front end of the hemmed piece is piled on its rear end to form a deflected piece, said deflecting device being installed at the delivery side of the first sewing machine;

a second sewing machine being installed at another inner corner side on the sewing table for closing the deflected piece;

a transfer device for transferring the deflected piece in a direction orthogonal to a feed direction of the feed device along the upper surface of the sewing table toward the second sewing machine; and a turning device for turning the deflected piece so that said front and rear ends coincide to a feed direction of the second sewing machines wherein, after turning the deflected piece by the turning device, said front and rear ends are sewn together by the second sewing machine.

According to this construction of the invention, the hemming step of the opening side of the sleeve, the two-fold deflecting step of the hemmed piece, and the tubular sleeve making step by sewing together edges of the deflected piece may be done continuously only by placing the sleeve blank on the feed device conveying surface. Besides, by the turning device, the deflected piece :s turned in a direction so that the edges may run along the feed direction of the second sewing machine.

The turning device of the invention is suited to the deflected piece, the edges of which to be sewn are straight when operating at the upstream side of the transfer device, and is ,suited to the deflected piece the edges of which are bent when operating just before the second sewing machine at the downstream side of the transfer device. For controlling the turning device, a detection sensor, or a counter for measuring the number of stitches of the sewing machine may be used.

Meanwhile, the turning device can convert the deflected piece direction by turning itself with the deflected piece held on the table, and by using the device, by pressing one point of the piece, it is possible to rotate about the pressed point by moving the other portion of the piece by means of the feed device or the transfer device.

It is another feature of the invention to deflect the front end of the hemmed piece dropped on the rear end of the hemmed piece in halves along the line orthogonal to the sewing line of the first sewing machine, by the deflecting device, after stopping the running of the front end portion of the hemmed piece being conveyed above the conveying surface. In the apparatus, a clamp is used for stopping the front end, but the hemmed piece can be folded back in two on the conveying surface without turning the clamp itself.

The mechanism of the deflecting device may be simplified by elevatably installing the clamp among the plurality of conveyor belts arranged at intervals so as to open toward the upstream side, or means for lifting the front end of the hemmed piece higher than the conveying surface may be separated from the clamp, with the clamp installed above the conveying surface. The deflecting device is preferably controlled by a sensor for detecting the hemmed piece on the conveying surface.

In the invention, when folding the blank in an S-form so that the edge of the opening side of the sleeve of the blank may be at the upper side and hemming the blank, developing means for developing the S-bent portion flat so that the edge may come to the lower side of the blank.

The other features and effects of the invention will be better appreciated and understood from the following detailed description of the embodiments taken in conjunction with the drawings.

DETAILED DESCRIPTION OF THE PREFERRED EMBODIMENT

Figure 1:
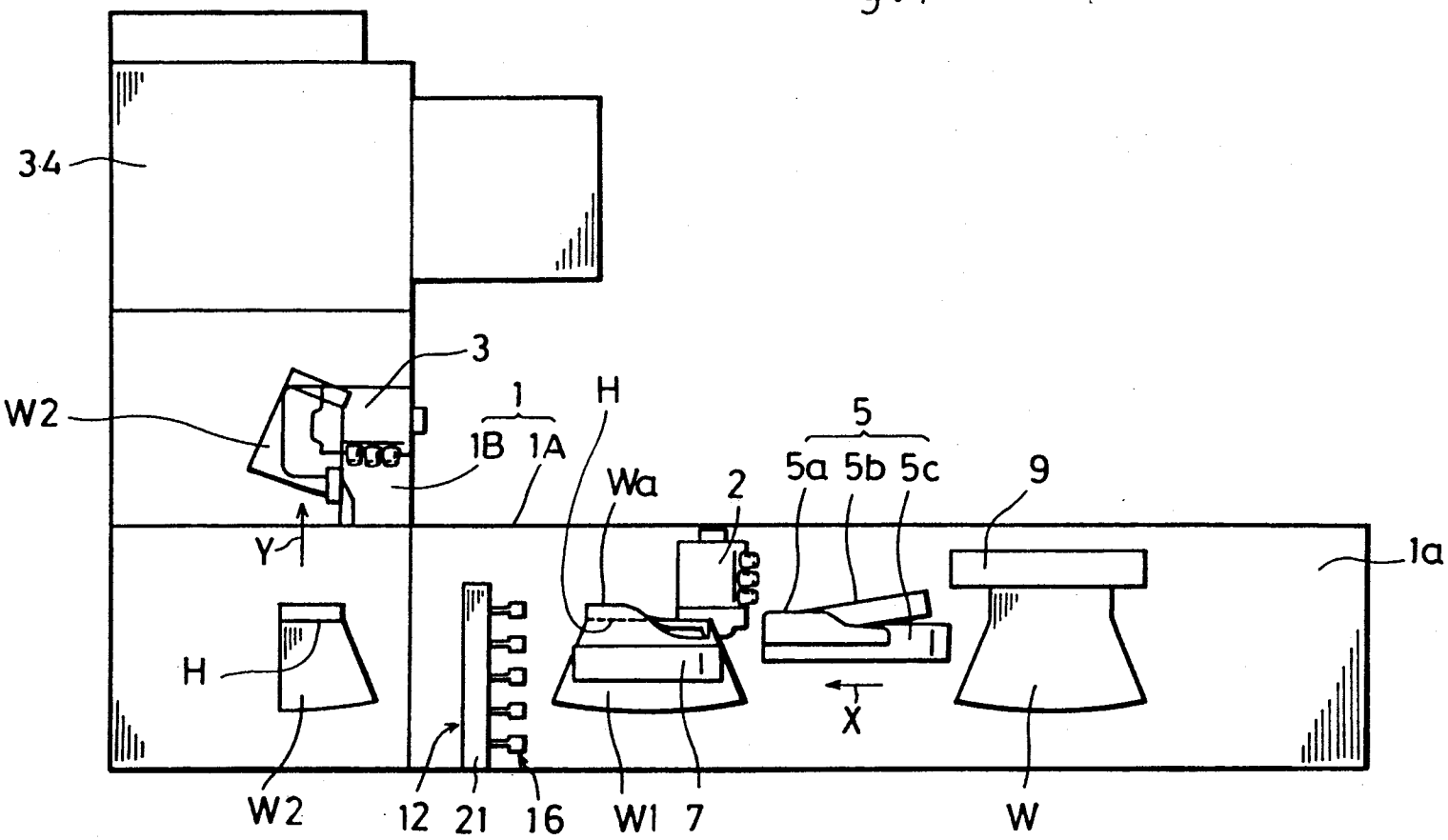
FIG. 1 is a plan view showing a general view of an automatic sewing apparatus for hemming and closing a sleeve according to one embodiment of the invention.
Figure 2:
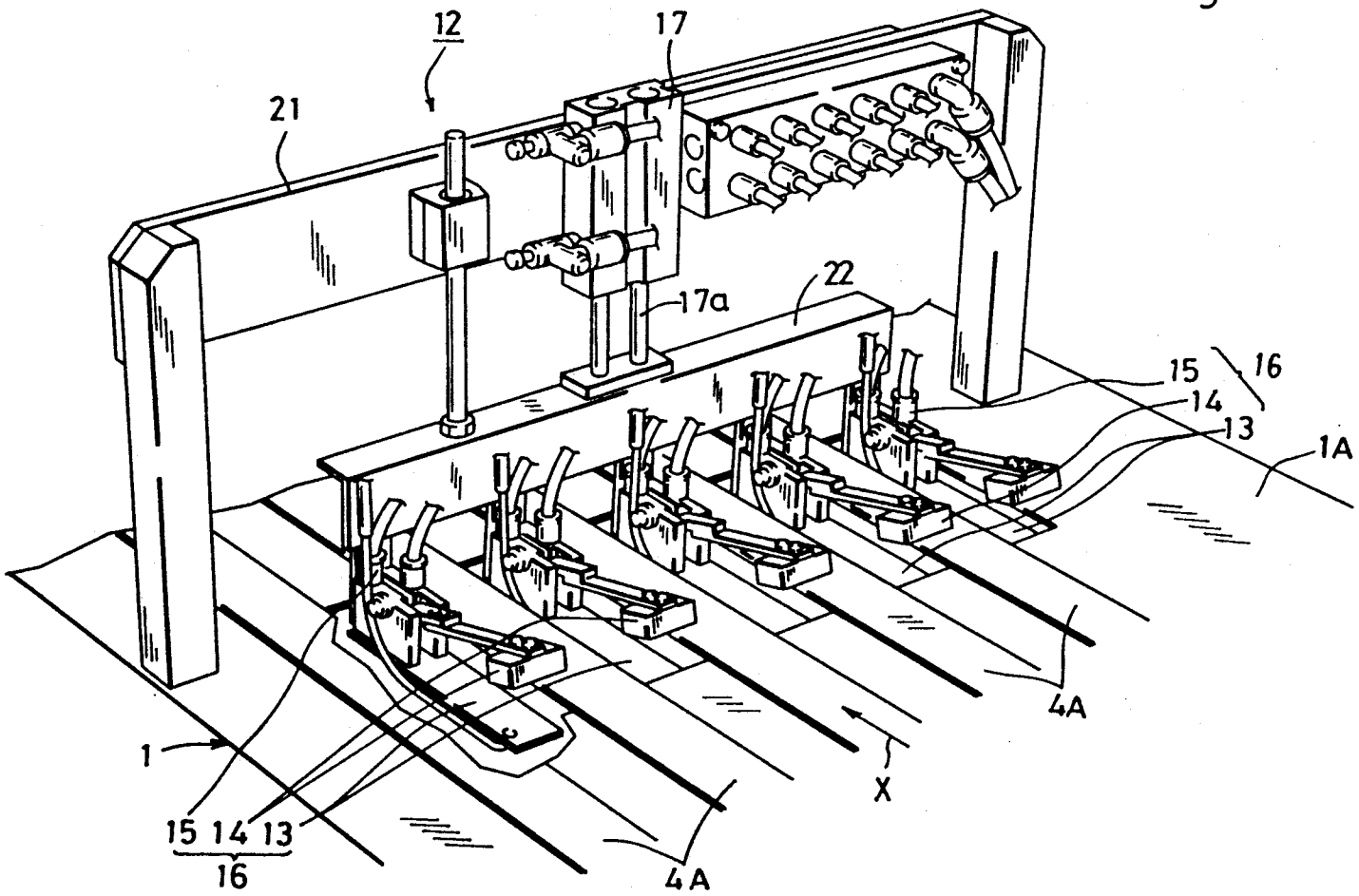
FIG. 2 is a partially cut-away magnified perspective view showing the structure of a deflecting device.

FIG. 1 is a plan view showing schematically a general structure of an automatic sewing apparatus for hemming and closing a sleeve, in which numeral 1 is a sewing machine table having an L-shaped blank mounting plane 1*a*, and a first sewing machine 2 and a second sewing machine 3 installed at the inner corner sides of the sewing machine table 1. On the blank mounting plane 1*a* of the table part 1A of the first sewing machine 2 side of the sewing machine table 1, several narrow first conveyor belts 4A are disposed in parallel at proper intervals in the direction orthogonal to the blank feeding direction before and after the first sewing machine 2 as shown in FIG. 2 through FIG. 6. Contiguously to the conveying end portion of each first conveyor belt 4A, several narrow second conveyor belts 4B having a conveying surface flush with the first conveyor belts 4A and in the same conveying direction are disposed, in parallel. The blank feed device 4 which nearly extends the overall length of the table part 1A is composed of these first conveyor belts 4A and second conveyor belts 4B.

Figure 3:
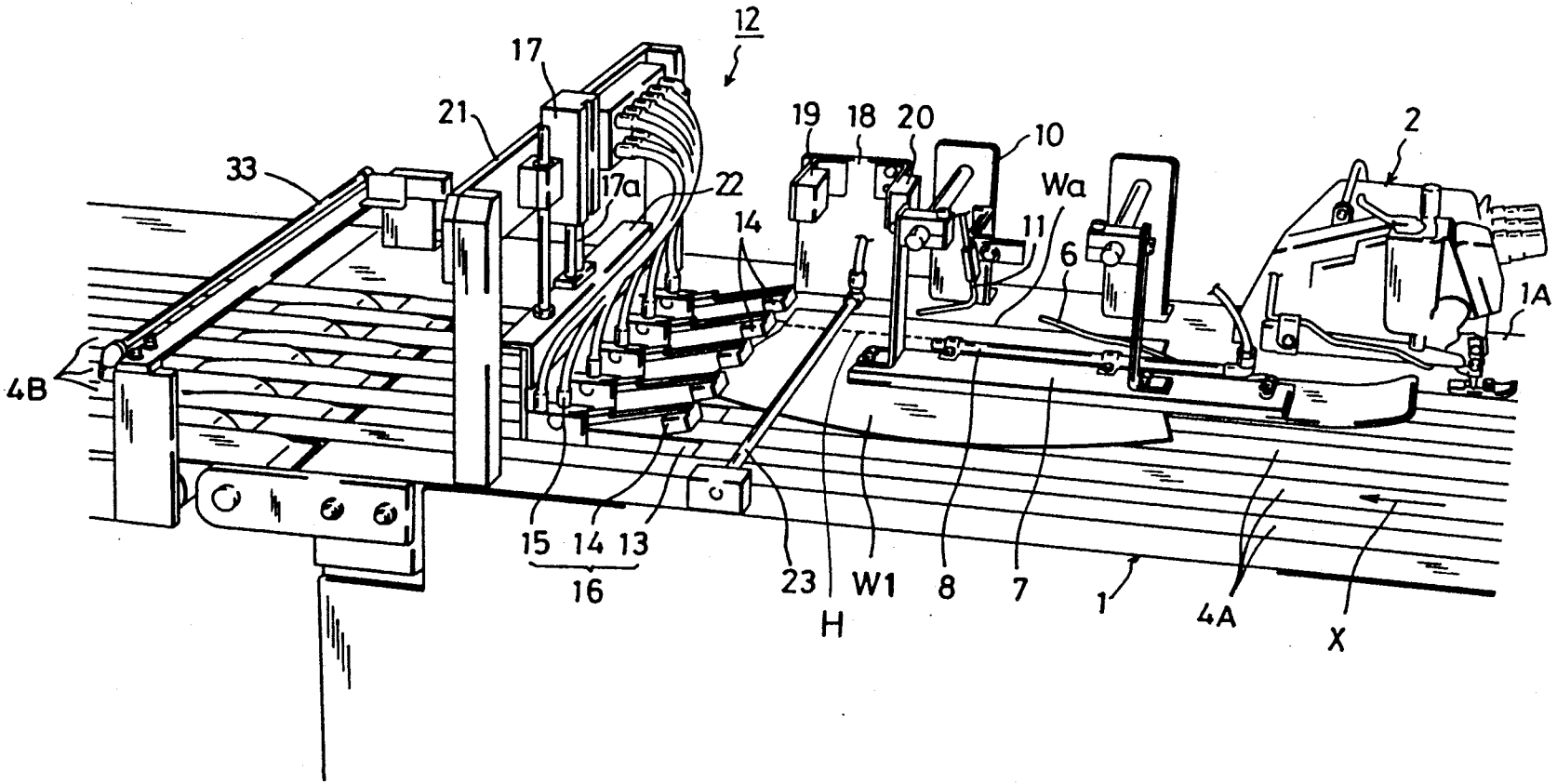
FIG. 3 is a perspective view showing the structure and operation from a first sewing machine to the deflecting device through a hemmed piece developing tool.

On the conveying surface of the first conveyor belts 4A, a folding device 5 is disposed before the first sewing machine 2. The folding device 5 is intended to fold an edge of a sleeve blank W in the shape as shown in FIG. 1 mounted along a fitting guide 9 on the conveying surface of the first conveyor belts 4A along the edge, in an S-form by means of three laminated plate members 5*a*, 5*b*, 5*c*, and by feeding the blank W passing through the folding device 5 to the first sewing machine 2, the S-formed folded edge is hemmed along the folding line to form a hemmed piece W1. Besides, on the conveying surface of the first conveyor belts 4A, at the delivery side of the first sewing machine 2, a bar-shaped developing tool 6 is installed. The developing tool 6 has one end fixed on a holding plate 7 for pressing down the hemmed piece W1 delivered from the first sewing machine 2, on the first conveyor belts 4A as shown in FIG. 3, and the other end of the tool 6 is projected obliquely across the hemming line H in the feed direction X of the blank W, and as shown in FIG. 7A to FIG. 7D, the S-formed folded part Wa of the hemmed piece W1 is sequentially developed flatly along with the conveyance of the hemmed piece W1 so that the edge of the blank W may be at the lower side of the hemmed piece W1 itself.

Along one edge in the widthwise direction of the holding plate 7, an air blow pipe 8 is fixed and another air blow pipe 11 is supported on a bracket 10 fixed at one end in the widthwise direction of the table part 1A corresponding to the front end part of the air blow pipe 8. On the peripheral walls of these air blow pipes 8 and 11, as indicated by arrows in FIG. 7B to FIG. 7D, nozzle holes 8A and 11A for blowing air toward the S-formed folded part Wa of the hemmed piece W1 are formed, and flattening of the piece W1 is assisted by the air blown from these nozzle holes 8A, and 11A, when flattening and developing the S-formed folded part Wa of the hemmed piece W1 by the developing tool 6.

Numeral 12 is a deflecting device for folding the hemmed piece W1 in halves after passing under the developing tool 6 along the line orthogonal to the hemming line H. The deflecting device 12 comprises an air cylinder 17 and a plurality of clamps 16 each having a fixed tongue 13, a movable tongue 14 and an air cylinder 15, as shown in FIG. 2 to FIG. 5. The fixed tongues 13 are disposed between adjacent conveyor belts 4A, 4A and the movable tongues 14 are disposed opposite to these fixed tongues 13. Each of the movable tongues 14 is constructed to be free to be driven by the cylinder 15 to open and close vertically toward the upstream side of the conveyor belts 4A. Each clamp 16 is free to hold and release the front end portion of the hemmed piece W1 conveyed on the conveyor belts 4A. The air cylinder 17 is installed as a driving mechanism for elevating the clamp for elevating and lowering all the blank clamps 16 between the holding position of the hemmed piece W1 shown in FIG. 3 and the upper position shown in FIG. 4 and FIG. 5. First and second sensors 19, 20 are mounted on a bracket 18 at an interval in the feeding direction X so as to detect the presence or absence of the hemmed piece W1 conveyed on the conveyor belts 4A.

Figure 4:
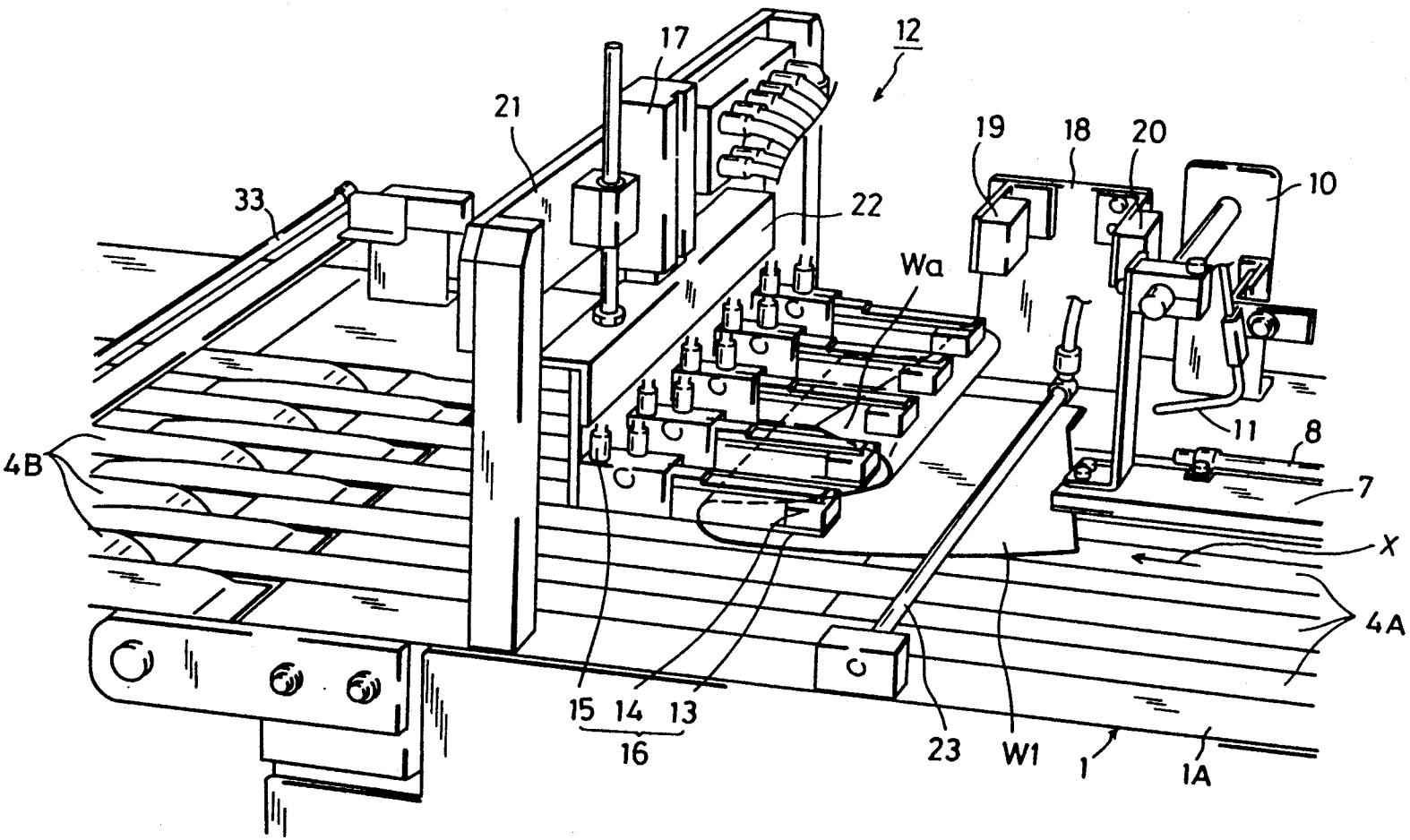
FIG. 4 is a perspective view of essential parts showing the holding state and lifting the front end portion of the hemmed piece by the plaiting device.
Figure 5:
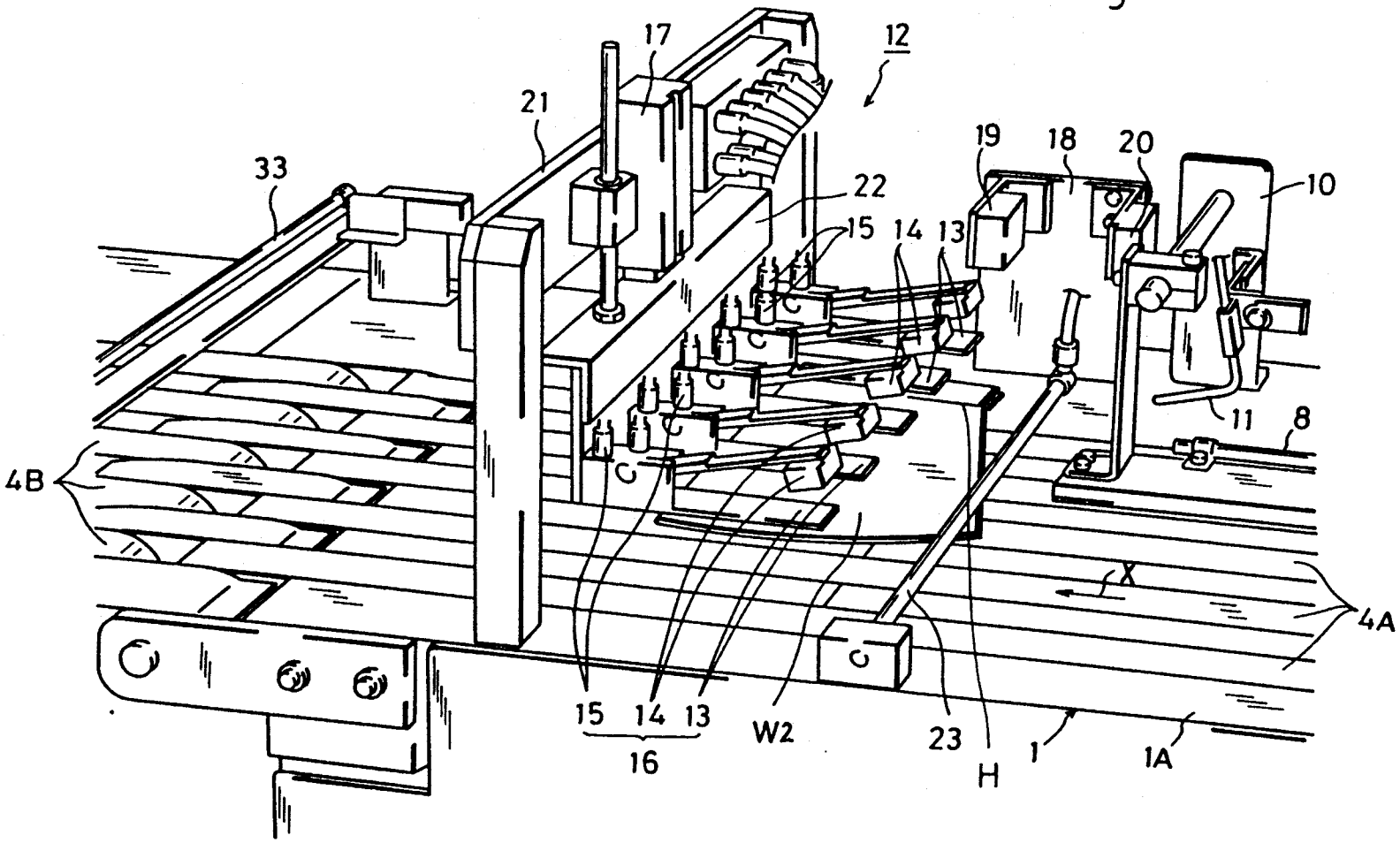
FIG. 5 is a perspective view of essential parts showing the state right after deflecting the hemmed piece in halves by the deflecting device.

The air cylinder 17 is fixed in the middle part of the portal frame 21 set up on the sewing machine table 1, and at the lower end of the piston rod 17*a* of the air cylinder 17 a support frame 22 for the blank clamp 16 is fixed and linked. The first blank sensor 19 and the second sensor 20 are designed to detect whether the hemmed piece W1 conveyed on the conveyor belts 4A is present at the specified position or not, and issue a detection signal. By the operation of the cylinder 15, based on the detection signal detecting the presence of the hemmed piece W1 by both sensors 19, 20, the both tongues 13, 14 of the clamp 16 are closed to hold the front end part of the hemmed piece W1, and by the actuation of the air cylinder 17, the clamp 16 and the front end part of the hemmed piece W1 are lifted above the conveying surface of the conveyor belts 4A to be stopped in the state shown in FIG. 4. Besides, in the holding and lifting state of the front end part as shown in FIG. 4, the rear end part of the hemmed piece W1 is conveyed continuously by the conveyor belts 4A, and when the second blank sensor 20 detects the absence of the hemmed piece W1, it indicates that the rear end part has passed. As a result, the signal is issued, and on the basis of the detection output signal, both tongues 13, 14 of the clamp 16 are opened by operation of the cylinders 15, and holding of the front end part of the hemmed piece W1 is canceled, so that the front end part is spontaneously lowered onto the rear end of the hemmed piece W1 so that the hemmed piece W1 is folded in half along the line orthogonal to the hemming line H. In FIG. 3 to FIG. 5, numeral 23 is an air blow pipe for blowing air toward the hemmed piece W1 lifted with the front end held by the clamp 16, and assisting the folding of the hemmed piece W1.

Figure 6:
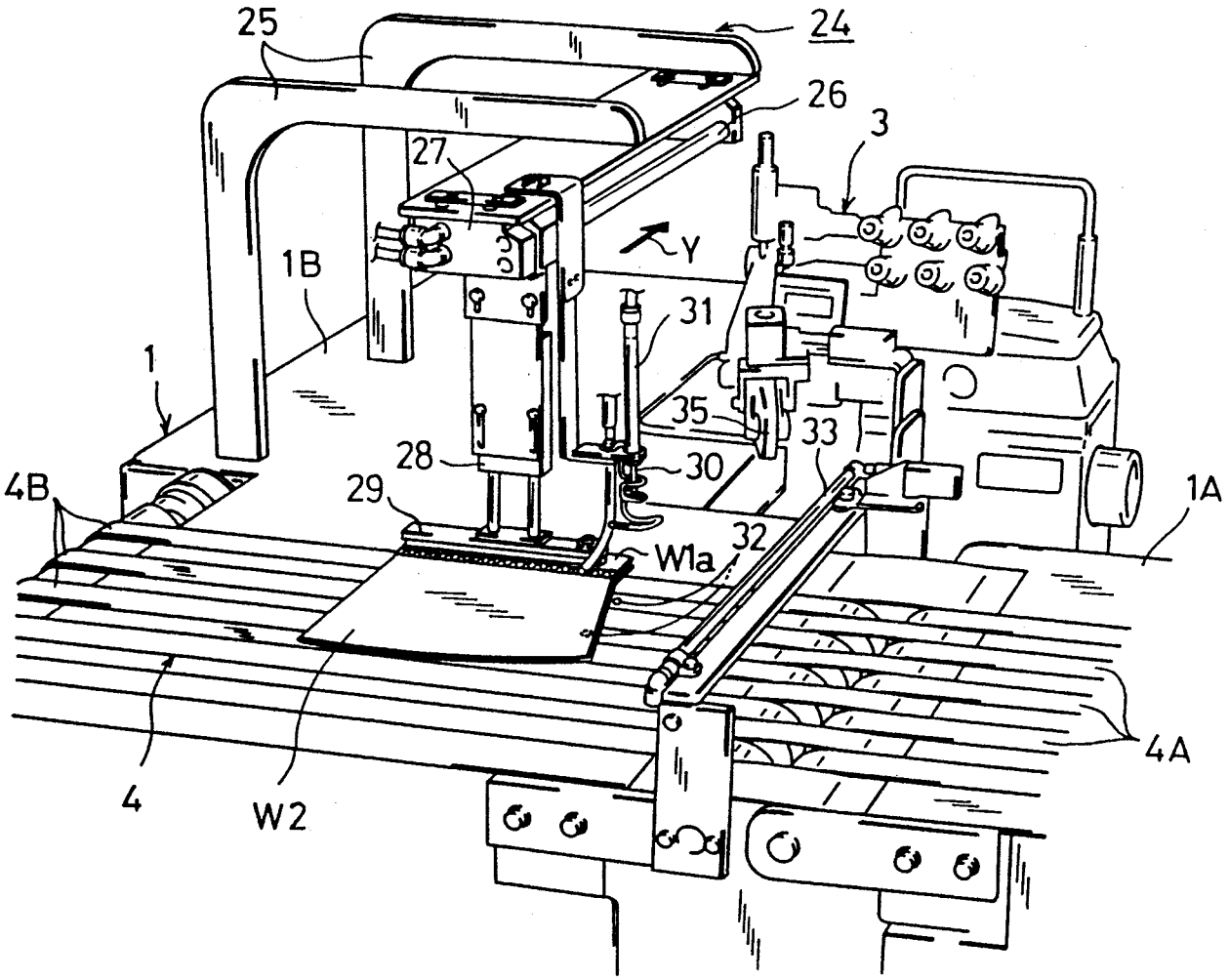
FIG. 6 is a perspective view of essential parts showing the structure and operation of a transfer device.
Figure 7A:
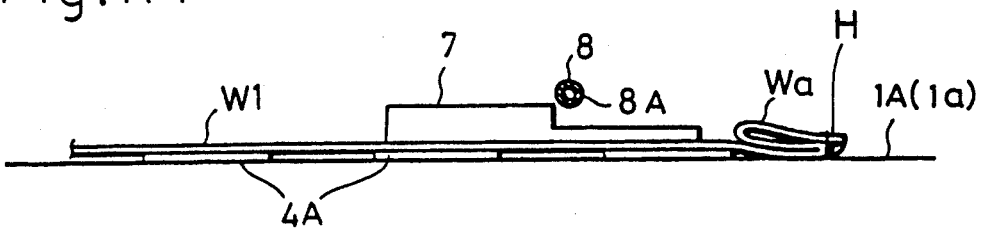
FIG. 7A to FIG. 7D are longitudinal front views of essential parts sequentially showing the operation for flattening and extending the hemmed piece.
Figure 7B:
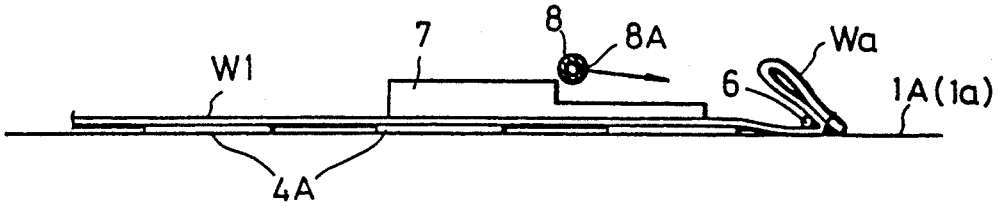
Figure 7C:
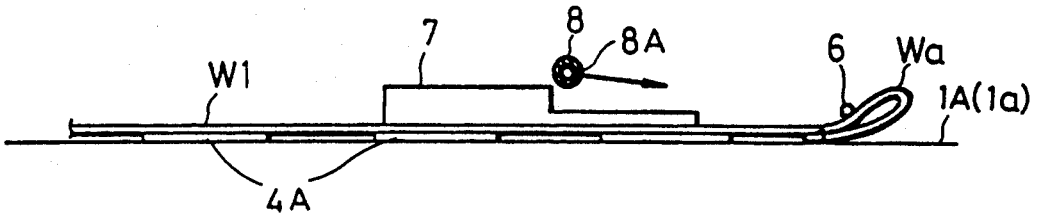
Figure 7D:
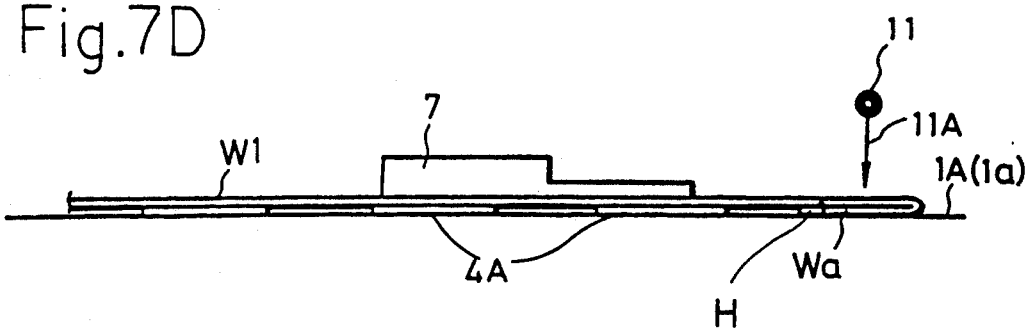

The deflected piece W2 thus folded in two is sent out, as shown in FIG. 6, onto the second conveyor belts 4B from the first conveyor belts 4A. The second conveyor belts 4B are arranged so as to be driven independently of the first conveyor belts 4A in order to match the sewing timing of the second sewing machine 3.

Numeral 24 denotes a transfer device for transferring the deflected piece W2 (FIG. 6) conveyed by the second conveyor belts 4B in a direction orthogonal to the feeding direction of the second conveyor belts 4B along the top surface of the table part 1B of the second sewing machine 3 side, and feeding the front and rear ends of the deflected piece W2 to the second sewing machine 3. The pressing transfer device 24 comprises a movable frame 27 freely supported by a guide rail 26 mounted on an L-arm 25 above the table part 1B to move vertically in a direction orthogonal to the feed direction of the second conveyor belts 4B, and a plate-shaped transfer member 29 having a pressing surface 29*a* for pressing the projected edge portion W1*a* to the mounting surface 1*a* of the table 1 long the hemming line H, which extends outside of the conveying surface of the second conveyor belts 4B, in the lowered state the member 29 is supported free to move up and down through a cylinder 28 attached to the movable frame 27 in the vertical position. Near the transfer device 24 there is provided a spot pressing member 30 for turning a direction of the deflected piece W2. The member 30 is free to move vertically through a pen cylinder 31, for pressing the local part near the conveying final end of the projected edge portion W1*a* to the upper surface of the table 1, along the hemming line H of the deflected piece W2, when the sewing line W1*b* to be sewn by the second sewing machine 3 of the deflected piece W2 is almost linear. A third sensor 32 is disposed in the gap between the adjacent surface of the second conveyor belts 4B so as to detect whether the edge portion W1*a* of the blank W1 has come up to the sewing line of the second sewing machine 3 or not, so that the piece W2 is fed by adjusting the position and direction with respect to the sewing line of the second sewing machine 3.

The pressing member 30 operates when the sewing line W1*b* to be sewn by the second sewing machine 3 of the piece W2 is nearly linear, as mentioned above and as shown in FIG. 12A. When the piece W2 conveyed in the X direction by the second conveyor belt 4B passes over the third sensor 32*a* at the front side, the pressing member 30 is moved down, and as shown in FIG. 12B, the portion near the end part of the projected edge portion 1*a* is pushed against the upper surface of the table 1, and as a result the deflected piece W2 is turned in the direction of arrow R about the pressing point through, the conveying force of the second conveyor belts 4B. When the third sensor 32*b* at the rear end detects the sewing line W1*b*, the operation of the second conveyor belts 4B is stopped, thereby turning the direction of the piece W2 so that the linear sewing line W1*b* of the piece W2 to be sewn may come on the sewing line of the second sewing machine 3 as shown in FIG. 12C.

When the deflected piece W2 is turned in the specified position and direction by the pressing member 30 and the second conveyor belts 4B, the plate-shaped transfer member 29 at the lower end of the movable frame 27 presses the edge part W1*a* along the hemming line H of the deflected piece W2 against the blank mounting surface 1*a* of the table 1 through the cylinder 28. In succession, the movable frame 27 moves linearly in a direction orthogonal to the feed direction of the second conveyor belts 4B along the guide rail 26, and by this movement the deflected piece W2 is transferred along the upper surface of the table part 1B of the second sewing machine 3 side, and its edges are supplied beneath the presser foot 36 of the second sewing machine 3.

Figure 8:
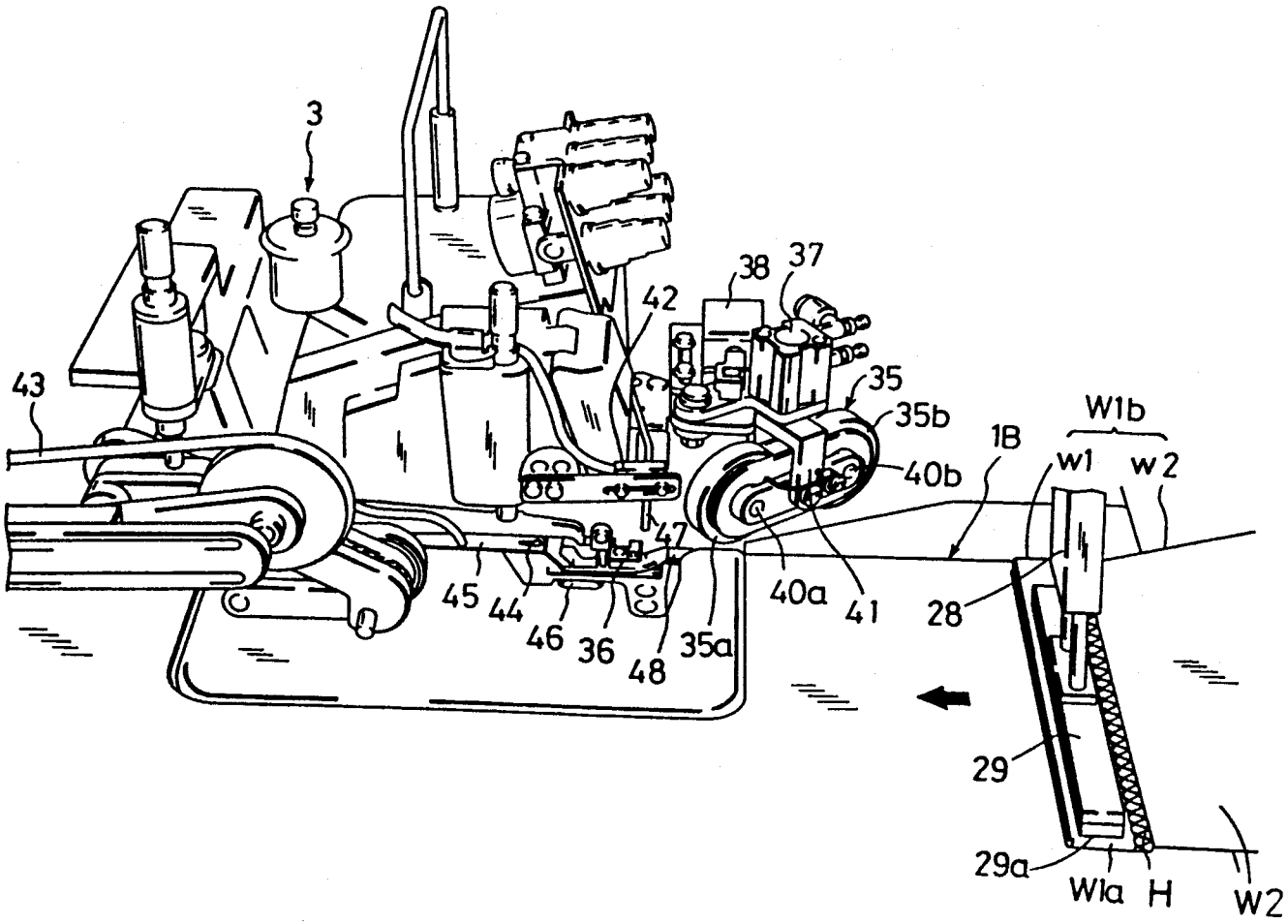
FIG. 8 is a perspective view of essential parts showing the structure and operation of a second sewing machine including a turning member.
Figure 9:
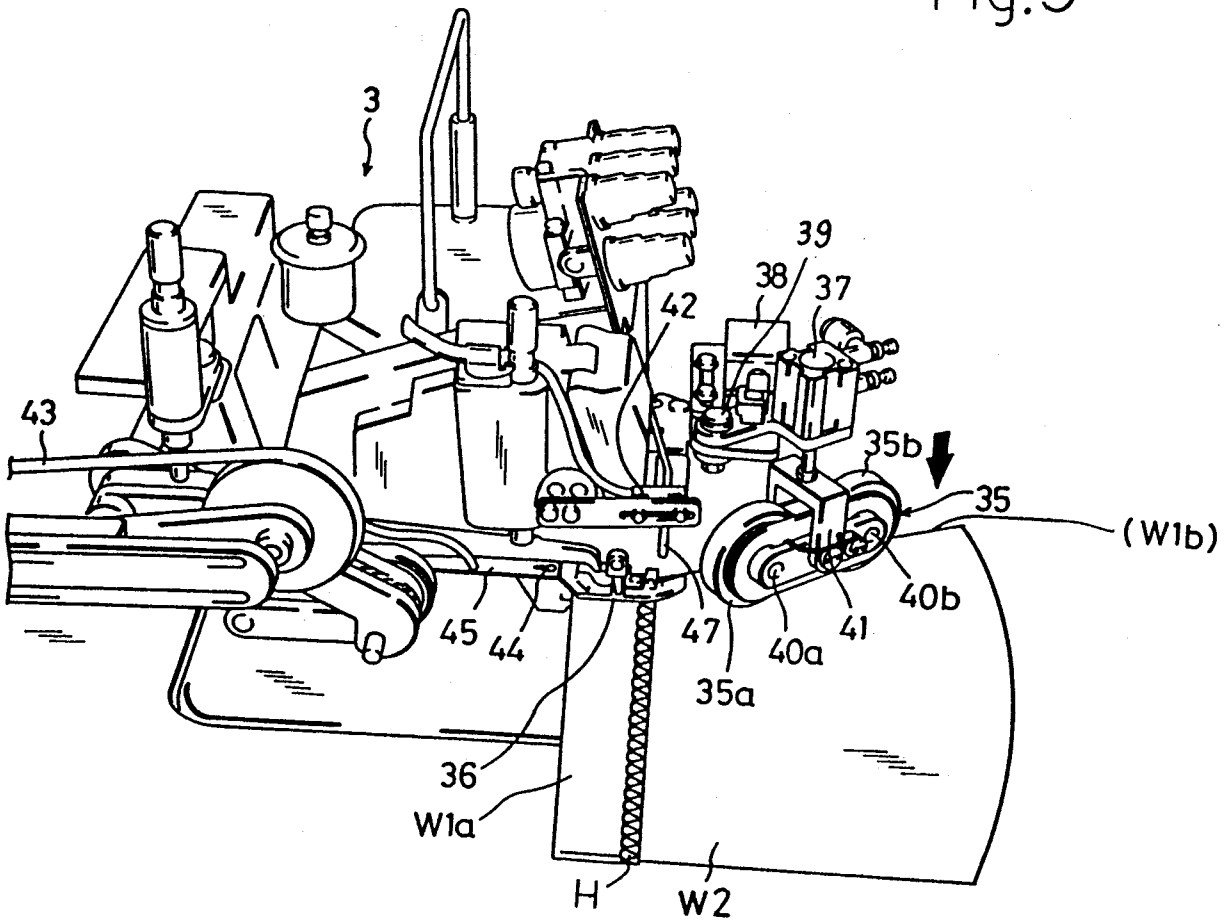
FIG. 9 is a perspective view of essential parts showing the state of contacting with the deflected piece as the turning member moves down.
Figure 10:
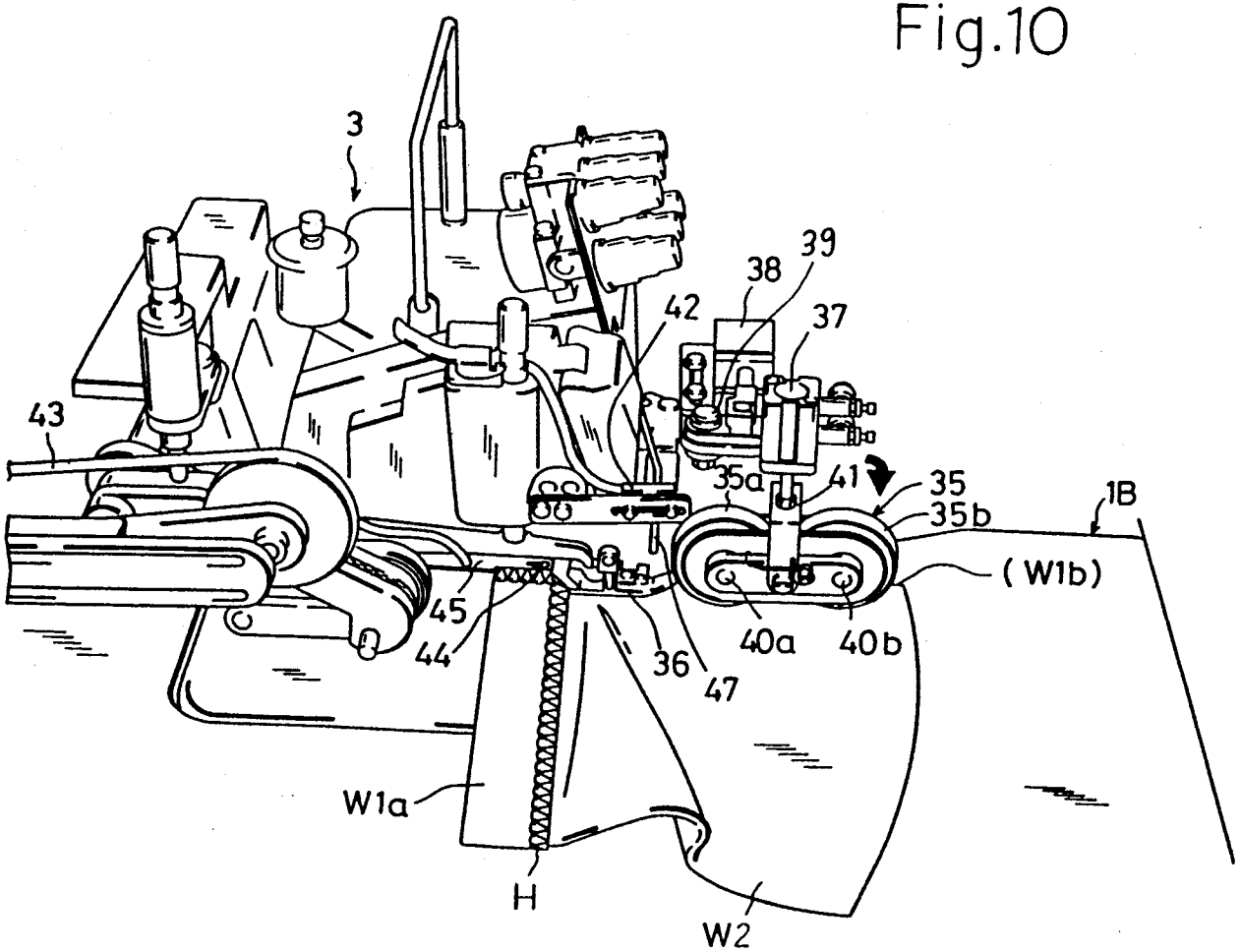
FIG. 10 is a perspective view of essential parts showing the state of the deflected piece turned in direction by the turning member.
Figure 11B:
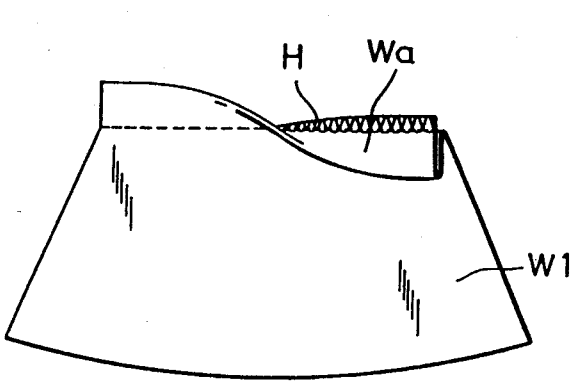
FIG. 11A to FIG. 11D are explanatory plan views sequentially showing the changes accompanying the sewing action of the blank having bent edges.
Figure 11A:
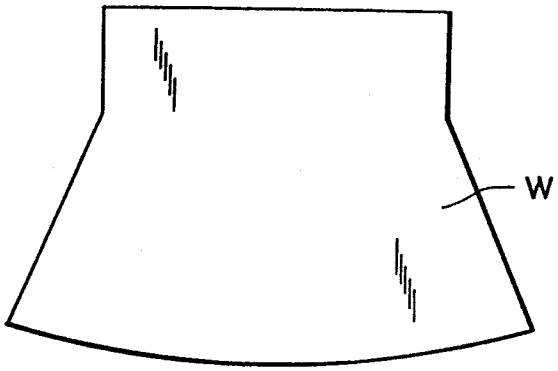
Figure 11D:
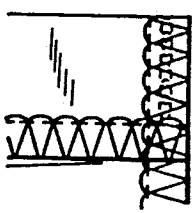
Figure 11C:
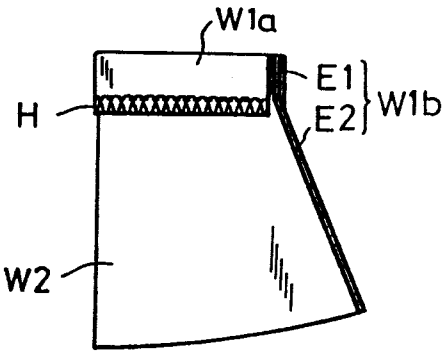

If the sleeve blank W is in the shape shown in FIG. 11A above the table part 1B of the second sewing machine 3, and the sewing line W1*b* of the deflected piece W2 to be sewn by the second sewing machine 3 is folded on the way as shown in FIG. 11C, the turning member 35 is disposed to change the direction of the deflected piece W2. The turning member 35 comprises two elastic rollers 35*a*, 35*b* freely rotating about horizontal axes 40*a*, 40*b* as shown in FIGS. 8 to 10, and a frame body 41 for bearing these rollers 35*a*, 35*b* is movable vertically by an air cylinder 37. The frame body 41 is designed to be rotatable about a vertical axis 39 by an air cylinder 38 in the lowered state. Furthermore, in the upper part of the presser foot 36 of the second sewing machine 3, there is a sensor 42 for detecting the deflected piece W2 transferred by the pressing transfer device 24 supplied above the presser foot 36, and a counter is disposed for measuring the number of stitches of the sewing machine 3 actuating by receiving a detection signal of the sensor 42. The second sewing machine 3 comprises the devices for sewing the chaining thread continuous to the sewing machine needle into the stitch at the beginning of sewing and includes, a chaining thread cutter 44, a chaining thread suction/discharge tube 45, chaining thread direction changing tubes 46, 47, and a chaining thread holder 48. These elements are disclosed in Japanese Laid-open Patent No. 1-171597 (corresponding to U.S. Pat. No. 4,934,293), and are known, and specific structural explanation thereof is omitted herein.

The turning member 35 is designed to operate in case the sleeve blank W is in a shape as shown in FIG. 11A, and the sewing line W1*b* of the deflected piece W2 to be sewn by the second sewing machine 3 is folded on the way as shown in FIG. 11A to FIG. 11C. The turning member 35 is usually placed in the upward position by the air cylinder 37 a as shown in FIG. 8. When the deflected piece W2 is supplied beneath the presser foot 36 of the second, sewing machine 3, the second sewing machine 3 is placed in action by receiving the detection signal from the sensor 42. The first linear portion W1 of the folded sewing line W1*b* is sewn by a specified number of stitches. When the linear sewing by the specified number of stitches is over, the air cylinder 37 receiving a signal, from the stitch counter is extended, and the turning member 35 moves down as shown in FIG. 9. The peripheral surfaces of the two rollers 35*a*, 35*b* are pressed against the deflected piece W2 on the table part 1B in front of the second sewing machine 3, while the turning member 35 is rotated about the vertical axis 39 as shown in FIG. 10 through the operation of the air cylinder 38. This rotation is designed to turn the direction of the deflected piece W2 into a position so that the second linear portion W2 of the bent sewing line W1*b* may come on the sewing line of the second sewing machine 3.

The turning pressing member 30 and the turning member 35 are designed so that one of the operating states may be selected by the operator as desired through a changeover switch, depending on the cutting shape of the sleeve blank W1. In FIG. 6, numeral 33 designates an air blow pipe for flattening the deflected piece W2, and in FIG. 1, numeral 34 is a stacker device for stacking up a plurality of sleeves fabricated in tubular form and discharging them outside as one lot, and a belt conveyor 43 is disposed at the second sewing machine 3 side for discharging products by conveying toward the stacker unit 34 after sewing the sleeves.

The thus arranged automatic sewing apparatus for hemming and closing a sleeve, operates as described below. The operation of the individual devices have been explained so far in relation to their structure, and the general operation is mainly explained below while referring to the drawings.

When the sleeve blank W is placed on the first conveyor belt 4A of the blank feed device 4 on the same plane as the table part 1A of the sewing machine table 1, with the edge running along the fitting guide 9 on the conveying surface, the sleeve blank W is conveyed in the direction indicated by the arrow X by the conveyor belts 4A. In the process of this conveyance, in the first place, the edge of the blank W is folded in an S-form by the folding device 5, is supplied from its front end into the first sewing machine 2, and is hemmed along the folding line. In succession, the S-formed folding part Wa of the hemmed piece W1 sent out from the first sewing machine 2 is conveyed, and is simultaneously flattened and developed by the blank developing tool 6 and the air blown out of the nozzle holes 8A, 11A, and is supplied into the deflecting device 12.

When the first blank sensor 19 detects that the front end of the hemmed piece W1 conveyed by the conveyor belts 4A toward the deflecting device 12 has reached the specified position, the blank clamp 16 holds the front end part of the hemmed piece W1 by the action of the cylinder 15 on the basis of the detection signal from the sensor 19, and by the action of the air cylinder 17, the blank clamp 16 and the front end part of the hemmed piece W1 are lifted upward from the conveying surface of the conveyor belts 4A to be stopped in the state as shown in FIG. 4. In this state, when the rear end of the hemmed piece W1 conveyed by the conveyor belt 4A reaches the specified position, the second blank sensor 20 issues an absence signal of the hemmed piece W1, and according to this signal the action of the cylinder 15 cause the blank clamp 16 to clear the holding of the front end part of the hemmed piece W1. As a result, the front end portion of the hemmed piece W1 drops spontaneously on the rear end portion of the hemmed piece, and the hemmed piece W1 is deflected in half as shown in FIG. 5, i.e., is folded along the line orthogonal to the hemming line H, the deflected piece W2 is sent out by the conveyor belt 4A, and the clamp 16 of the deflecting device 12 is lowered, thereby returning to the waiting state for the next hemmed piece W1.

The operation described so far refers to the sleeve blank W as shown in FIG. 11A, and it is the same if the sewing line W1*b* of the deflected piece W2 by the second sewing machine 3 is folded on the way as shown in FIG. 11C, or the sewing line W1*b* of the deflected piece W2 by the second sewing machine 3 is nearly straight as shown in FIG. 12, but after this step the operation is different, and each case is described separately hereinafter.

First of all, when the sewing line W1*b* of the deflected piece W2 formed by the second sewing machine 3 a is folded on the way as shown in FIG. 11C, the deflected piece W2 extending from the deflecting device 12 is flattened by the air blown out from the air blow pipe 33, and when the flattened deflected piece W2 reaches the specified position, it is stopped in the specified position and specified direction by receiving the detection signal of the front side third sensor 32*a*, and the lower end pressing surface 29*a* of the pressing transfer device 24 presses the edge part W1*a* along the hemming line H of the deflected piece W2 to the mounting surface 1*a* of the table 1.

In succession, the movable frame 27 moves linearly in the direction orthogonal to the feed direction of the second conveyor belts 4B as indicated by the arrow Y in FIG. 6 along the guide rail 26, and as a result of the movement the deflected piece W2 is transferred along the upper surface of the table part 1B of the second sewing machine 3 side, and its edge is positioned beneath the presser foot 36 of the second sewing machine, 3. The second sewing machine 3 is placed in action by receiving the detection signal from the blank sensor 42, and the linear portion E1 of the folded line W1*b* is sewn with the specified number of stitches. When linear sewing with the specified number of stitches is complete a signal is received from the stitch counter, the turning member 35 moves down as shown in FIG. 9, and the peripheral surfaces of the two rollers 35*a*, 35*b* press the portion near the sewing line E1 of the deflected piece W2 to the table part 1B. The turning member 35 is rotated about the vertical axis 39 as shown in FIG. 10 through the operation of the air cylinder 38. By this rotation, the second linear portion E2 of the folded sewing line W1*b* of the deflected piece W2 is turned in its direction to such a position as to come onto the sewing line of the second sewing machine 3, and the second linear portion E2 of the folded sewing line W1*b* is sewn by the second sewing machine 3, thereby fabricating a tubular sleeve as shown in FIG. 11D. Meanwhile, sewing of the first and second linear portions E1, E2 is done continuously without stopping the second sewing machine 3. Thus a fabricated sleeve is sent into the stacker device 34, and is formed in to a plurality of laminates. The plurality of laminated sleeves are discharged outside as one lot.

Figure 12A:
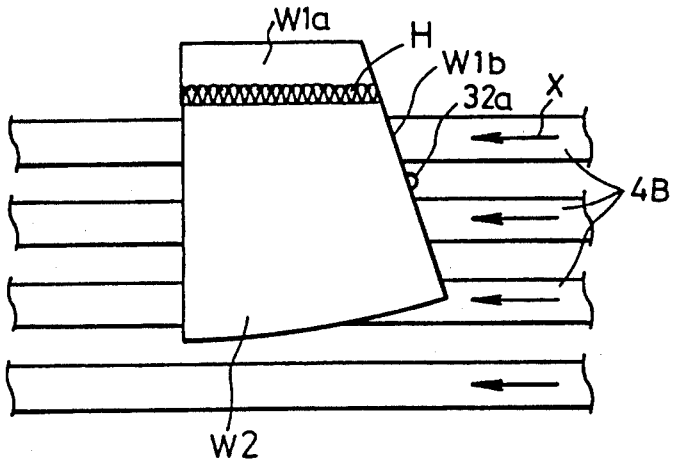
FIG. 12A to FIG. 12C are explanatory plan views sequentially showing the blank direction turning action having a straight edge part.
Figure 12B:
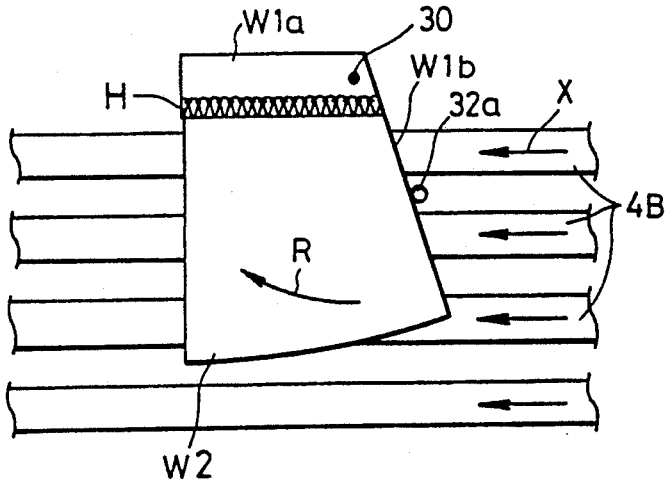
Figure 12C:
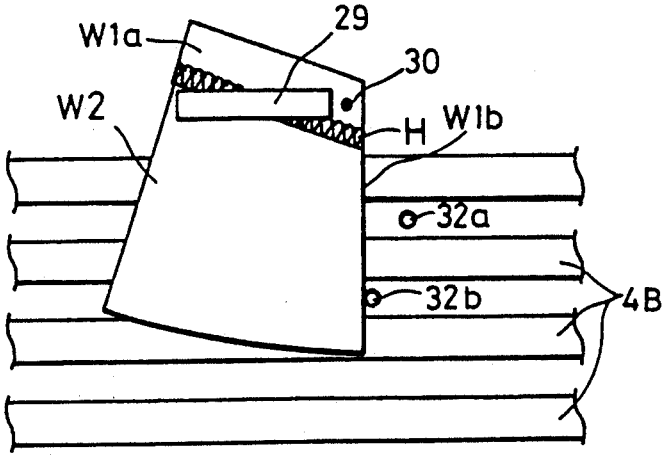

On the other hand, when the sewing line W1*b* to be sewn by the second sewing machine 3 is almost linear, as shown in FIG. 12A to FIG. 12C, the deflected piece W2 is flattened by the air blown from the air blow pipe 33, and when the flattened deflected piece W2 passes through a specified position, the pressing member 30 moves down through the pen cylinder 31, which operates by receiving a detection signal from the front side third sensor 32*a*, and as shown in FIG. 12A, the portion near the rear end of the projected edge part W1*a* of the deflected piece W2 conveyed in the direction X by the second conveyor belts 4B is pressed on the top surface of the table 1, as shown in FIG. 12B, in the conveying state. As a result, the blank W1 is rotated in the direction of arrow R about the pressing point through the conveying force of the second conveyor belts 4B, and when the sewing line W1*b* formed by the second sewing machine 3 is detected by the rear side third sensor 32*b*, the second conveyor belts 4B are stopped. The direction of the deflected piece W2 is accordingly changed to such a position that the sewing line W1*b* may come onto the sewing line by the second sewing machine 3 as shown in FIG. 12C.

In succession, the plate-shaped transfer member 29 of the transfer device 24 is lowered and its lower end pressing surface 29*a* presses the edge part W1*a* along the hemming line H of the deflected piece W2 against the mounting surface 1*a* of the table 1, and then the movable frame 27 moves linearly in a direction orthogonal to the feed direction of the second conveyor belts 4B as indicated by arrow Y in FIG. 6 along the guide rail 26. As a result of this movement the deflected piece W2 is moved along the upper surface of the table part 1B to the second sewing machine 3, and its front and rear edges are supplied beneath the presser foot 36 of the second sewing machine 3. Then the second sewing machine 3 is placed in action by receiving the detection signal of the blank sensor 42, and a tubular sleeve is made by being sewn together along the linear sewing lines W1*b* of both edges. Thus a fabricated sleeve is, as in the case above, sent into the stacker device 34. As a plurality of laminates, and the plurality of laminated sleeves are discharged outside as one lot.

Thus, by only putting the sleeve blank W successively on the conveying surface of the feed device 4 at a specified position at one end of the sewing machine table 1, the procedure of making a tubular sleeve making procedure of by S-folding, hemming by the first sewing machine 2, developing and flattening of the S-fold, folding into two halves, changing the direction of the plaited blank W1, and sewing of the edge portions of the deflected piece W2 may be done full-automatically and continuously. Thereby, labor is saved, productivity is enhanced, and the space of the entire apparatus may be small.

In either case two types of sleeve blanks W differing in shape, may be manufactured by using only one automatic sewing apparatus, only by selecting the changeover switch by the operator, for the direction turning action suited to each case.

In particular, by holding the front end part of the hemmed piece W1 when being conveyed through the conveyor belts 4A by the clamp 16 a which is operated by receiving a detection signal of the first sensor 19, and lifting and holding the holding point, the hemmed piece W1 is conveyed continuously with its rear end placed on the conveyor belts 4B. Only by releasing the hold by the blank clamp 16, which receives a signal from the second sensor when the rear end part reaches a specified position, the hemmed piece W2 is folded into halves on the horizontal plane, and therefore as compared with the case of picking up the entire blank or pushing up the center of it to fold it in two on the vertical plane, the deflecting function may be realized more securely and accurately regardless of the material and characteristic of the blank W.

As the blank developing tool 6 in the embodiment, a plate-shaped one may be also used. In the foregoing embodiment, two direction turning members 35, 30 are disposed so as to be applicable whether sewing line W1*b* of the deflected piece W2 by the second sewing machine 3 is curved or straight, and the operating states of the two members 35, 30 are selected by the changeover switch, but either one of the direction turning members may be provided.

In the embodiment, first the blank edge is folded in an S-form by the folding member 5, and the folded line is hemmed by the overlock sewing machine, and then the S-folded portion is flattened by the developing tool 6, so that the edge is sewn to the lower side of the blank. But it may also be possible to use the folding member in a horizontal J-form, fold the edge to the lower side of the blank, and sew by using a lock stitch sewing machine or an interlock stitch sewing machine.

What is claimed is:

1. An automatic sewing apparatus for forming a tubular sleeve by hemming and closing a blank, comprising:

a sewing table on which a running direction is defined, said sewing table having an L-shaped blank mounting surface defining a plane and having inner corner sides;

a first sewing machine for hemming the blank to form a hemmed piece, the first sewing machine being installed on the sewing table at one inner corner side;

a feed device having a conveying surface in the same plane as the sewing table;

a folding device for folding back the edge of an opening side of the blank along the running direction, the folding device being installed on the conveying surface of the feed device before the first sewing machine;

at least one sensor for detecting the hemmed piece on the conveying surface;

a deflecting device for folding the hemmed piece into halves along a line orthogonal to the hemming line, so that a front end of the hemmed piece is piled on its rear end to form a deflected piece, said deflecting device being installed at the delivery side of the first sewing machine, said deflecting device having an elevating member and a clamping member;

a second sewing machine for closing the deflected piece, said second sewing machine being installed at another inner corner side on the sewing table;

a transfer device for transferring the deflected piece in a direction orthogonal to a feed direction of the feed device along the upper surface of the sewing table toward the second sewing machine; and a turning device for turning the deflected piece so that said front and rear ends coincide to a feed direction of the second sewing machine, wherein, after turning the deflected piece by the turning device, said front and rear ends are sewn together by the second sewing machine, wherein, said at least one sensor generates a first signal and a second signal, said first signal being applied to the elevating member for raising the front end of the running hemmed piece to an upper position from the conveying surface, the clamping member stops the running of the front end of the hemmed piece at the upper position by gripping the front end of the hemmed piece, and wherein said second signal being applied to the clamping member to release the front end to drop it on the rear end of the running hemmed piece in order to fold it into halves.

2. The automatic sewing apparatus for forming a tubular sleeve by hemming and closing a blank of claim 1, wherein the feed device has a plurality of belts disposed parallel to each other, and the clamping member is disposed between the belts and is movable up and down adjacent the conveying surface of the feed device between the belts, said clamping member comprising, plural pairs of tongues opening and closing vertically in a direction upstream of the feed device at the intervals of the belts to clamp a front end of the hemmed piece on the surface of the belts, and wherein the elevating member raises the clamping member with the front end of the hemmed piece, to the upper position.

3. The automatic sewing apparatus for forming a tubular sleeve by hemming and closing a blank of claim 1, wherein the turning device is disposed above the sewing table between the transfer device and the second sewing machine, the turning device comprising a pressing member movable vertically and rotatable around a vertical axis, and wherein movement of the hemmed piece is changed as the pressing member is rotated with the hemmed piece pressed on the sewing table.

4. The automatic sewing apparatus for forming a tubular sleeve by hemming and closing a blank of claim 3, wherein the second sewing machine comprises a sensor for detecting the deflected piece, and a stick counter for counting a number of stitches by the second sewing machine, and wherein the stitch counter is actuated depending on a deflected piece detection signal generated by the sensor, and the operation of the pressing member is controlled as a function of the number of stitches counted.

5. The automatic sewing apparatus for forming a tubular sleeve by hemming and closing a blank of claim 1, wherein the turning device has a spot pressing element installed above the sewing table near the conveying surface of the feed device between the deflecting device and the transfer device, the spot pressing element presses one point of the deflected piece projecting out of the conveying surface in the midst of conveyance of the deflected piece on the table, and wherein the deflected piece is rotated about said one point, thereby changing the direction of the deflected piece.

6. The automatic sewing apparatus for forming a tubular sleeve by hemming and closing a blank of claim 1, wherein the turning device comprises a first turning device and a second turning device, the first turning device being provided with pressing elements movable vertically and rotatable around a vertical axis, said first turning device being installed above the sewing table between the transfer device and the second sewing machine, thereby turning the deflected piece by rotating horizontally with the deflected piece pressed on the sewing table by the pressing elements, and the second turning device being provided with a pressing member movable vertically and installed above the sewing table outside of the conveying surface of the feed device between the deflecting device and the transfer device, thereby turing the direction of the deflected piece by holding one point of the deflected piece projecting outside of the conveying surface in the midst of conveyance of the deflected piece on the table by the pressing member so as to turn the direction of the deflected piece as the deflected piece rotates about that point.

7. The automatic sewing apparatus for forming a tubular sleeve by hemming and closing a blank of claim 1, wherein the folding device has a plural it of guide plates extending vertically so as to fold the blank in an S-form such that an edge of the sleeve of the blank is located at the upper side of the blank, and a developing tool for flattening the S-folded part of the blank hemmed along the S-form folded line so that the edge is located at the lower side of the blank.

8. The automatic sewing apparatus for forming a tubular sleeve by hemming and closing a blank of claim 7, wherein the developing tool comprises a shielding object contacting the upper surface of the blank crossing obliquely above the sewing line of the blank hemmed by the first sewing machine.

9. The automatic sewing apparatus for forming a tubular sleeve by hemming and closing a blank of claim 7, wherein the developing tool comprises a blow pipe for blowing air into the folded part of the sewing line of the blank hemmed by the first sewing machine.

* * * * *

UNITED STATES PATENT AND TRADEMARK OFFICE

CERTIFICATE OF CORRECTION

PATENT NO. : 5,226,378

DATED : July 13, 1993

INVENTOR(S) : Yukinori Suzuki et al

It is certified that error appears in the above-identified patent and that said Letters Patent is hereby corrected as shown below:

Claim 4, column 12, line 16, "stick" should be "stitch".

Claim 6, column 12, line 53, "turing" should be "turning".

Claim 7, column 12, line 63, "plural it" should be "plurality".

Claim 9, column 14, line 6, "further" should be inserted between "tool" and "comprises".

Signed and Sealed this

Fifth Day of April, 1994

Bruce Lehman

*Attest:*

BRUCE LEHMAN

*Attesting Officer*

*Commissioner of Patents and Trademarks*